US010643437B2

(12) United States Patent
Matsuoka et al.

(10) Patent No.: US 10,643,437 B2
(45) Date of Patent: May 5, 2020

(54) PROTECTOR, MEDIUM STORAGE DEVICE, AND MEDIUM PROCESSING DEVICE

(71) Applicant: Oki Electric Industry Co., Ltd., Tokyo (JP)

(72) Inventors: Gentaro Matsuoka, Tokyo (JP); Yoshinari Kobayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/302,621

(22) PCT Filed: Apr. 6, 2017

(86) PCT No.: PCT/JP2017/014419
§ 371 (c)(1),
(2) Date: Nov. 16, 2018

(87) PCT Pub. No.: WO2017/199623
PCT Pub. Date: Nov. 23, 2017

(65) Prior Publication Data

US 2019/0206197 A1 Jul. 4, 2019

(30) Foreign Application Priority Data

May 19, 2016 (JP) ..... 2016-100649

(51) Int. Cl.
*G06Q 40/00* (2012.01)
*G07F 19/00* (2006.01)
*G07D 9/00* (2006.01)

(52) U.S. Cl.
CPC ..... *G07F 19/205* (2013.01); *G07D 9/00* (2013.01)

(58) Field of Classification Search
CPC .... G07F 19/20; G07F 19/201; G06Q 20/1085
USPC ..... 235/379
See application file for complete search history.

(56) References Cited

U.S. PATENT DOCUMENTS 4,275,667 A * 6/1981 Hilton ..... B65H 1/027 109/44
2010/0200448 A1* 8/2010 Doi ..... G07D 9/00 206/459.1
2011/0132718 A1* 6/2011 Park ..... G07F 19/20 194/206
2012/0255829 A1 10/2012 Togiya
2013/0026178 A1* 1/2013 Peters ..... G07D 11/13 221/279

(Continued)

FOREIGN PATENT DOCUMENTS

JP S59-100371 U 7/1986
JP 2011-118699 A 6/2011
JP 2015-125624 A 7/2015

(Continued)

*Primary Examiner* — Ahshik Kim
(74) *Attorney, Agent, or Firm* — Rabin & Berdo, P.C.

(57) ABSTRACT

A protector includes a cover that is attachable to a casing formed with an opening through which the medium passes from an outside for storing the medium in an internal storage space or feeding the medium from the internal storage space to the outside, and that covers the opening when attached to the casing; and an attaching portion that extends so as to face toward a side surface of the casing from an end of the cover, and includes a fitting portion that fits with a fitting portion formed on the side surface of the casing.

18 Claims, 9 Drawing Sheets

(56) References Cited

U.S. PATENT DOCUMENTS

2017/0365122 A1* 12/2017 Bang ..... G07F 19/20
2019/0197812 A1* 6/2019 Toyoda ..... G07D 11/245

FOREIGN PATENT DOCUMENTS

JP 2015-215791 A 12/2015
JP 2016-028977 A 3/2016

* cited by examiner

PROTECTOR, MEDIUM STORAGE DEVICE, AND MEDIUM PROCESSING DEVICE

TECHNICAL FIELD

The present invention relates to a medium storage device and a medium processing device, and is, for example, applied to an Automatic Teller Machine (ATM) into which a medium such as a banknote is input with by a customer, and that performs desired transactions.

BACKGROUND ART

ATMs and the like, for example, into which a customer inputs cash such as banknotes and coins, and that pays out cash to the customer according to the content of a transaction initiated by the customer, are widely employed in financial institutions and the like. An ATM has been proposed that includes, for example, a banknote pay-in/pay-out port that exchanges banknotes with a customer, a conveyance section that conveys banknotes along a conveyance path, a classification section that classifies the denominations and authenticity of the inserted banknotes, a temporary holding section that temporarily holds inserted banknotes, and banknote cassettes that store banknotes by denomination (see, for example, Japanese Patent Application Laid-Open (JP-A) No. 2011-118699).

Generally, banknote cassettes of an ATM are provided with a cassette handover guide that guides banknotes when banknotes input to the ATM. In addition, banknote cassettes are attachable and detachable from the ATM, and are transported for supplementing and recovering the banknotes.

SUMMARY OF THE INVENTION

Technical Problem

In such banknote cassettes, the cassette handover guide may be damaged by the handling during transport. When a banknote cassette that has damaged the cassette handover guide is loaded to the ATM, an error such as a banknote jam might occur, due to the damaged portion of the cassette handover guide when banknotes are transported between the cassette handover guide and the ATM.

In consideration of the above circumstances, the invention disclosure proposes a protector, a medium storage device and a medium processing device capable of increasing reliability in the operation of an ATM.

Solution to Problem

In order to address such issues, in a protector of the invention, there are provided a cover that is attachable to a casing formed with an opening through which the medium passes from an outside for storing the medium in an internal storage space or feeding the medium from the internal storage space to the outside, and that covers the opening when attached to the casing; and an attaching portion that extends so as to face toward a side surface of the casing from an end of the cover, and forms a fitting portion that fits with a fitting portion formed on the side surface of the casing.

Moreover, in a medium storage device of the invention, there are provided a casing having an opening through which the medium passes from an outside for storing the medium in an internal storage space or feeding the medium from the internal storage space to the outside; and a protector that includes a cover that is attachable to the casing and covers the opening when attached to the casing, and an attaching portion that extends so as to face toward a side surface of the casing from an end of the cover and forms a fitting portion that fits with a fitting portion formed on the side surface of the casing.

Further, in a medium processing device of the invention, there are provided a casing that is configured so as to attachable and detachable from a casing loading space formed in a predetermined frame, and that has an opening through which the medium passes from an outside for storing the medium in an internal storage space or feeding the medium from the internal storage space to the outside; and a protector that includes a cover that is attachable to the casing and covers the opening when attached to the casing, and an attaching portion that extends so as to face toward a side surface of the casing from an end of the cover and forms a fitting portion that fits with a fitting portion formed on the side surface of the casing.

The protector is attached to the casing such that the cover portion covers the opening during transporting the medium storage device, and therefore the invention may prevent damage to the cassette handover guide by an impact from the outside.

Effects of the Invention

The invention enables a protector, a medium storage device and a medium processing device capable of increasing the reliability in the operation of an ATM or the like.

DESCRIPTION OF EMBODIMENTS

Explanation follows regarding embodiments for implementing the invention (referred to below as exemplary embodiments), with reference to the drawings.

1. First Exemplary Embodiment

1-1. Configuration of ATM

Figure 1:
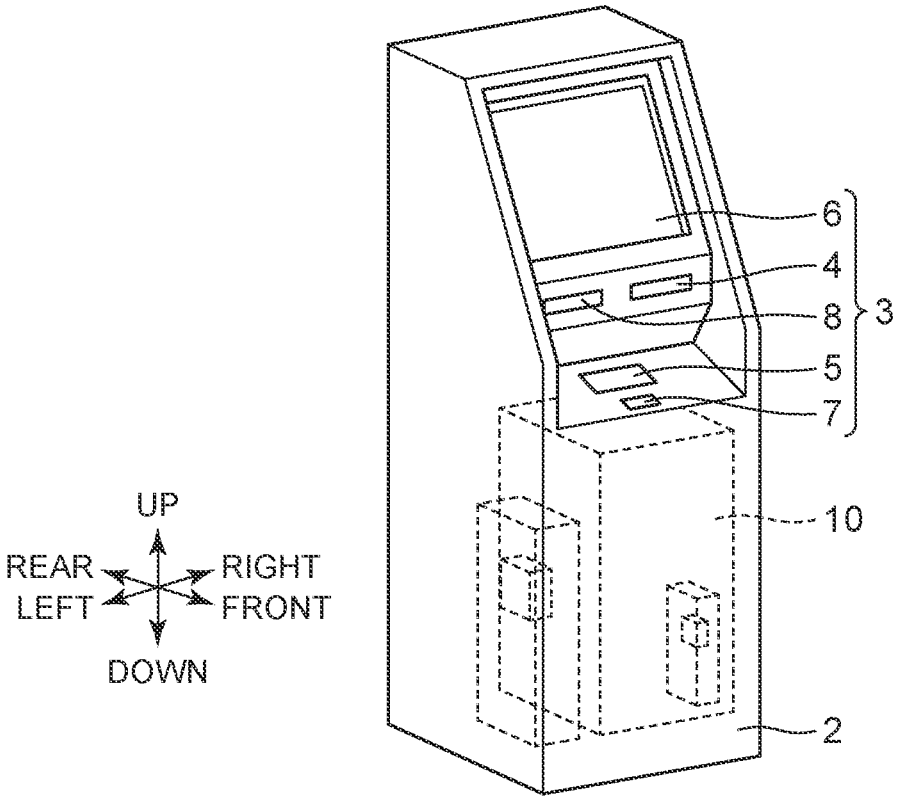
FIG. 1 is a perspective view illustrating a configuration of an ATM.

As illustrated in the external view of FIG. 1, an ATM 1 is configured mainly by a box shaped casing 2, and is, for example, installed in a financial institution or the like to perform cash transactions such as pay-in transactions and pay-out transactions with a user (that is, a customer of the financial institution).

The casing 2 is provided with a customer interface section 3 at a location enabling easy banknote insertion, touch panel operation, and so on by the customer who is facing the front side of the casing 2. The customer interface section 3 includes a card insertion/removal port 4, a pay-in/pay-out port 5, an operation and display section 6, a ten digit-keypad 7, and a receipt issue port 8. Cash, passbooks, and the like are passed between the customer interface section 3 and the customer directly, and the customer interface section 3 provides transaction information and receives operation instructions. The card insertion/removal port 4 is a section for insertion and return of the various cards such as cash cards. A card processor (not illustrated in the drawings) that reads account numbers and the like magnetically recorded on the various cards is provided behind the card insertion/removal portion 4. The pay-in/pay-out port 5 is a section that banknotes being paid in by the customer are input, and that dispenses banknotes being paid out to the customer. The operation and display section 6 is integrated with a Liquid Crystal Display (LCD) that displays operation screens during a transaction, and a touch panel for inputting transaction type selections, PINs, transaction amounts, and the like. The ten digit-keypad 7 is a physical keypad by which, for example, the numbers 0 to 9 are input, and is employed during PINs and transaction amount input operations and the like. The receipt issue port 8 is a section that issues receipts on which the content of a transaction and the like are printed at the end of transaction processing.

In the following explanation, the side of the ATM 1 faced by a user is defined as the front side, and the opposite side thereto is defined as the rear side. The left side and the right side are respectively defined by the left and right from the perspective of a user facing the front side, and the upper side and lower side are also defined from the perspective of a user facing the front side.

A main controller 9 that performs overall control of the entire ATM 1, a banknote pay-in/pay-out device 10 that performs various processing related to banknotes and the like, are provided inside the casing 2. The main controller 9 is configured mainly by a Central Processing Unit (CPU), not illustrated in the drawings, and reads and executes predetermined programs from Read Only Memory (ROM) or flash memory or the like, in order to control the respective sections so as to perform various processing in pay-in transactions, pay-out transactions, and the like. The main controller 9 includes a storage section configured by Random Access Memory (RAM), a hard disk drive, flash memory, and the like inside, and stores various information in the storage section.

1-2. Configuration of the Banknote Pay-In/Pay-Out Device

Figure 2:
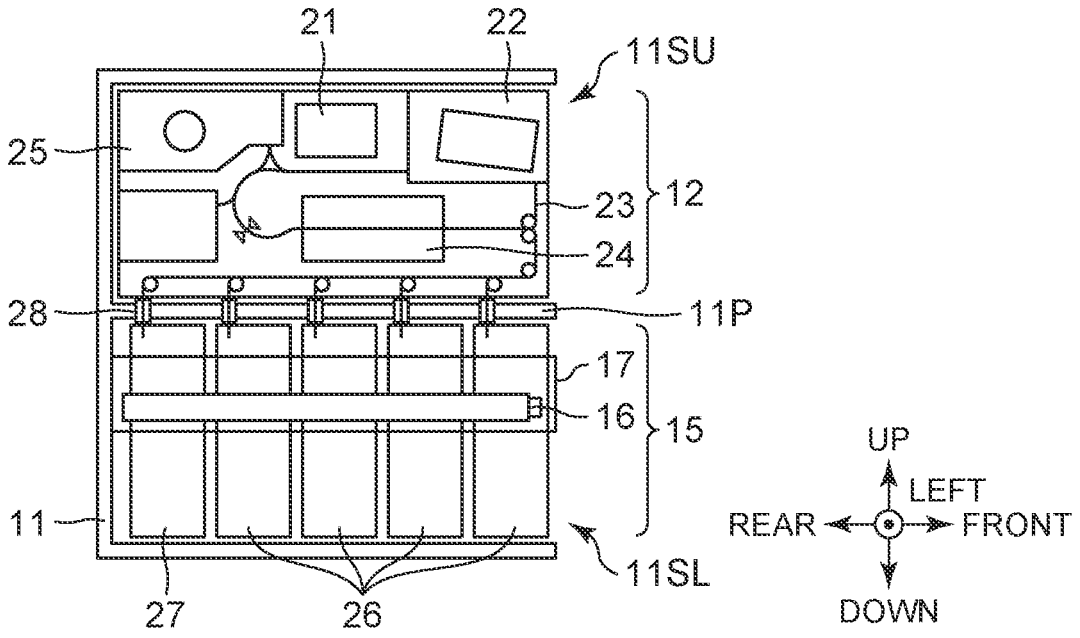
FIG. 2 is a left side view illustrating a configuration of a banknote pay-in/pay out device.

As illustrated in FIG. 2, the banknote pay-in/pay-out device 10 is incorporated inside a pay-in/pay-out device casing 11 configured in a hollow cuboidal shape, with different sections for performing various processing related to banknotes as a medium. The front side of the pay-in/pay-out device casing 11 is open, the interior of the pay-in/pay-out device casing 11 is partitioned into an upper space 11SU at the upper side and a lower space 11SL at the lower side, by partitioning portion 11P provided at substantially the vertical direction central of the pay-in/pay-out device casing 11. The upper space 11SU and the lower space 11SL respectively house an upper unit 12 and a lower unit 15.

The upper unit 12 is provided with a banknote controller 21 that performs overall control of the entire upper unit 12, a pay-in/pay-out section 22 that exchanges banknotes with the customer, a conveyance section 23 that conveys banknotes to the various sections, a classification section 24 that classifies banknotes, and a temporary holding unit 25 that temporarily stores banknotes.

The banknote controller 21 is mainly configured by a CPU, not illustrated in the drawings, similarly to the main controller 9. The banknote controller 21 reads and executes predetermined programs from ROM, flash memory, or the like, not illustrated in the drawings, to perform various processing such as processing to determine the conveyance destination of banknotes and processing to control operation of the various sections. The banknote controller 21 includes an internal storage section configured by RAM, flash memory, or the like, which stores various information.

The pay-in/payout section 22 is positioned at an upper front portion of the ATM inside the upper unit 12. The pay-in/pay-out section 22 separates banknotes received from the customer one by one and passes the banknotes to the conveyance section 23. The pay-in/pay-out section 22 also stacks banknotes conveyed from the conveyance section 23 and allows the user to take out the banknotes. Conveyance guides that guide banknotes, several rotating rollers, and moving belts and the like are disposed as appropriate in the conveyance section, thereby forming a conveyance path (shown by solid lines in the drawings) for conveying banknotes. The conveyance section 23 conveys banknotes in a direction parallel to their short ends along the conveyance path by rotating each of the rollers as appropriate and moving each of respective belts as appropriate.

The classification section 24 is disposed along the conveyance path of the banknotes. Different types of sensors are incorporated inside the classification section 24 in order to identify the denomination, authenticity, physical condition (whether it is damaged or not), and the like of the conveyed banknotes. The results of this identification process are sent to the banknote controller 21. The temporary holding section 25 employs what is known as a tape escrow method, and stores banknotes by wrapping the banknotes against a circumferential side of a circular shaped drum together with a tape, and feeds out the banknotes by peeling the tape away from the circumferential side of the circular shaped drum.

Multiple banknote cassettes 26 and a reject cassette 27 that store banknotes are provided in the lower unit 15. The banknote cassettes 26 are all similarly configured, and each includes an internal space for stacking and storing banknotes. The banknote cassettes 26 internally stack and store banknotes that have been determined by the classification section 24 and the banknote controller 21 to have a light degree of damage and to be suitable for re-use, and the banknote determined the light degree of damage has been conveyed by the conveyance section 23 according to their denominations. In response to receipt of an instruction from the banknote controller 21 to feed out banknotes, the banknote cassettes 26 separate and feed out the stacked banknotes one by one, and pass the banknotes to the conveyance section 23.

The reject cassette 27 includes an internal space for stacking and storing banknotes. The reject cassette 27 has a general appearance similar to the banknote cassette 26. The reject cassette 27 internally stores banknotes that have been determined by the classification section 24 and the banknote controller 21 to have a high degree of damage and to be unsuitable for re-use (referred to as reject banknotes), and the banknote determined the high degree of damage has been conveyed by the conveyance section 23.

Multiple handover sections 28 are disposed along the front-rear direction between the upper unit 12 and the lower unit 15 in the pay-in/pay-out device casing 11, that is, at the partitioning portion 11P. The handover sections 28 guide the passage of banknotes during handover of banknotes between the conveyance section 23 and the banknote cassettes 26 or the reject cassette 27.

In cases in which, for example, the customer initiates a pay-in transaction with the ATM 1, in coordination with the main controller 9 and the like, after receiving predetermined operation input from the operation and display section 6, the banknote controller 21 opens the shutter of the pay-in/pay-out port 5 (FIG. 1) to allow insertion of banknotes into the pay-in/pay-out section 22. After banknotes have been inserted, the pay-in/pay-out section 22 shuts the shutter of the pay-in/pay-out port 5, and then separates the banknotes one by one and passes the banknotes to the conveyance section 23. The conveyance section 23 conveys the received banknotes to the classification section 24 for classification, and the banknote controller 21 is notified of the obtained classification results. The banknote controller 21 decides a conveyance destination of each banknote accordingly. When this is performed, the conveyance section 23 conveys banknotes classified by the classification section 24 as normal (referred to as normal notes) to the temporary holding section 25 where banknotes are temporarily held. The conveyance section 23 conveys banknotes classified as unsuitable for transactions (referred to as damaged banknotes, counterfeit banknotes, or the like) to the pay-in/pay-out section 22 for return to the customer.

The banknote controller 21 then prompts the customer to confirm the pay-in amount using the operation and display section 6 (FIG. 1), and conveys the banknotes held in the temporary holding section 25 to the classification section 24 where the banknotes are classified by denomination, degree of damage, and the like, and acquires the classification results. The banknote controller 21 then conveys banknotes with the high degree of damage to the reject cassette 27 via the respective handover section 28 so as to be stored as reject banknotes that are unsuitable for re-use. The banknote controller 21 also conveys banknotes with the light degree of damage to the banknote cassettes 26 of the corresponding denominations via the respective handover section 28 so as to be stored as banknotes suitable for re-use.

On the other hand, in cases in which, for example, the customer initiates a pay-out transaction with the ATM 1, in coordination with the main controller 9 and the like, after receiving predetermined operation input from the operation and display section 6 (FIG. 1), the banknote controller 21 feeds out banknotes from the banknote cassettes 26 according to the amount to be paid out. The banknote controller 21 then passes the banknotes via the respective handover section 28 to the conveyance section 23, and uses the conveyance section 23 to convey the banknotes to the classification section 24 for classification, before conveying the banknotes to the pay-in/pay-out section 22 and opening the shutter of pay-in/pay-out port 5 (FIG. 1) to allow the customer to take out the banknotes.

The front side of the casing 2 of the ATM 1 is configured by a door that is able to be opened and closed. Opening the door enables access to the banknote pay-in/pay-out device 10 from the outside. The lower unit 15 described above is attached to the pay-in/pay-out device casing 11 of the banknote pay-in/pay-out device 10 through slide rails 16.

Thus, in the banknote pay-in/pay-out device 10, the lower unit 15 is moved in the front-rear direction while extending and contracting the slide rails 16 in a state in which the door of the casing 2 has been opened. Thereby the banknote pay-in/pay-out device 10 transitions between a state in which the lower unit 15 is housed inside the lower space 11SL of the pay-in/pay-out device casing 11, and a state in which the lower unit 15 is pulled out to the front side of the pay-in/pay-out device casing 11.

1-3. Configuration of the Lower Unit

Figure 3:
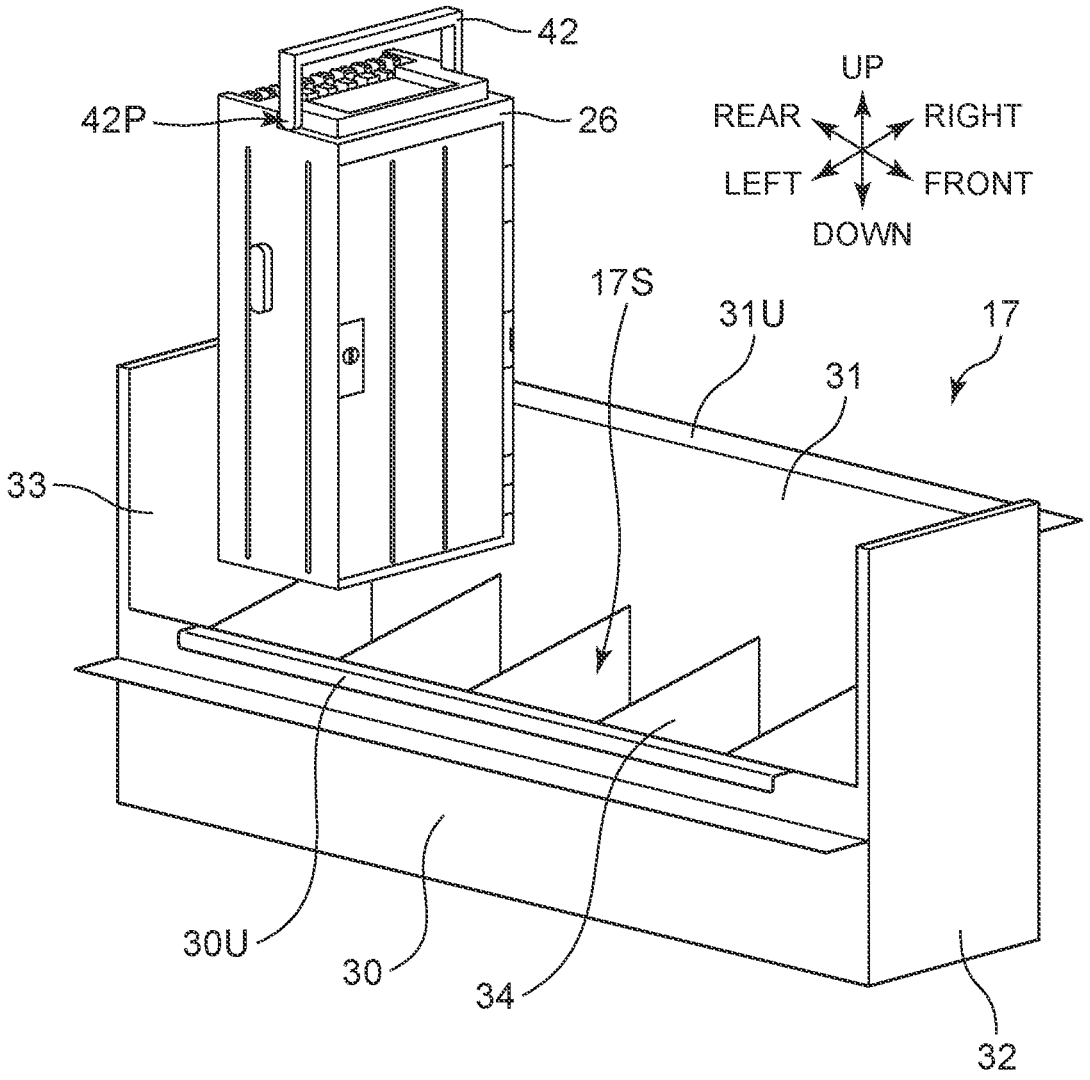
FIG. 3 is a perspective view illustrating a configuration of a lower unit during loading a banknote cassette according to a first embodiment.

In the lower unit 15, five banknote cassette loading spaces 17S are disposed in a row along the front-rear direction in a lower frame 17 attached to the slide rails 16, as illustrated in FIG. 3. Each banknote cassette loading space 17S is configured by a rectangular shaped hole penetrating in the vertical direction. A portion that supports a respective banknote cassette 26 or the reject cassette 27 is formed at both the left and right sides of each banknote cassette loading space 17S.

Thus, in lower unit 15, the banknote cassettes 26 are able to be loaded into the banknote cassette loading spaces 17S by lowering the banknote cassettes 26 down from upper side of respective banknote cassette loading spaces 17S by holding a handle 42 in a state in which the lower frame 17 has been pulled out to the front of the pay-in/pay-out device casing 11. Moreover, in the lower unit 15, the banknote cassettes 26 may also be removed from the banknote cassette loading spaces 17S by lifting the banknote cassettes 26 up by holding the handle 42 in a state in which the lower frame 17 loaded with the banknote cassettes 26 has been pulled out to the front of the pay-in/pay-out device casing 11. Incidentally, in the lower unit 15, the reject cassette 27 is attached to/detached from the respective banknote cassette loading spaces 17S of the lower frame 17 similarly to the banknote cassettes 26.

Further, when the banknote cassettes 26 have been loaded into the lower frame 17 and the lower frame 17 is stored inside the pay-in/pay-out device casing 11 (FIG. 2), upper surfaces of the banknote cassettes 26 face the handover sections 28 provided at the partitioning portion 11P of the pay-in/pay-out device casing 11 such that the banknote cassettes 26 are disposed at respective positions for performing handover of banknotes to and from the handover sections 28.

In this manner, in the banknote pay-in/pay-out device 10, when the banknote cassettes 26 have been respectively loaded into the banknote cassette loading spaces 17S of the lower frame 17 and the lower frame 17 is stored inside the pay-in/pay-out device casing 11, each of the banknote cassettes 26 is able to hand over banknotes with the respective handover sections 28 of the pay-in/pay-out device casing 11.

The lower frame 17 is configured overall to surround the periphery of five banknote cassette loading spaces 17S as a whole by a left side plate 30, a right side plate 31, a front side plate 32, and a rear side plate 33, which are each steel plate members. Four partitioning plates 34 are disposed evenly spaced between the front side plate 32 and the rear side plate 33. The left end and the right end of each partitioning plate 34 are fixed to the left side plate 30 and the right side plate 31 respectively. The lower frame 17 forms a long space in the front-rear direction by the left side plate 30, the right side plate 31, the front side plate 32, and the rear side plate 33, and the long space is partitioned into five banknote cassette loading spaces 17S by four partitioning plates 34.

The right side plate 31 is formed with a right side plate upper end surface 31U that is a flat plane facing upward by bending an upper end portion of the right side plate 31 at right angle toward the right side, thereby securing the strength of the right side plate 31. Further, the left side plate 30 is formed with a left side plate upper end surface 30U that is a flat plane facing upward by bending an upper end portion of the left side plate 30 at right angle toward the left side, thereby securing the strength of the left side plate 30. In the left side plate 30 and the right side plate 31, notches, not illustrated in the drawings, fitting respectively to a maintenance side protrusion 52 and a non-maintenance side protrusion 54 (described later) of each banknote cassette 26, are provided, thereby preventing each banknote cassette 26 from being wrongly loaded into the banknote cassette loading spaces 17S in the left-right reversed state.

In the lower frame 17, the upper end of the left side plate 30 is lower than the upper end of the right side plate 31. When various operations or work or the like (hereinafter, referred to as maintenance work) is performed by the operator or the like in the lower frame 17, the operator or the like is assumed to be positioned at a left side of the lower frame 17, and it is intended to increase work efficiency, such as in loading or unloading of the banknote cassettes 26 having a large weight by the operator or the like. Further, by setting the height of the right side plate 31 as high as possible, the lower frame 17 suppresses the vibration of the banknote cassettes 26 by a positioning portion (not illustrated in the drawings) of the upper end portion side in the right side plate 31 when the banknotes cassettes 26 are loaded. Hereinafter, a left side and a right side of the lower frame 17 are also referred to as a maintenance side and a non-maintenance side respectively.

1-4. Configuration of Banknote Cassettes

Figure 4:
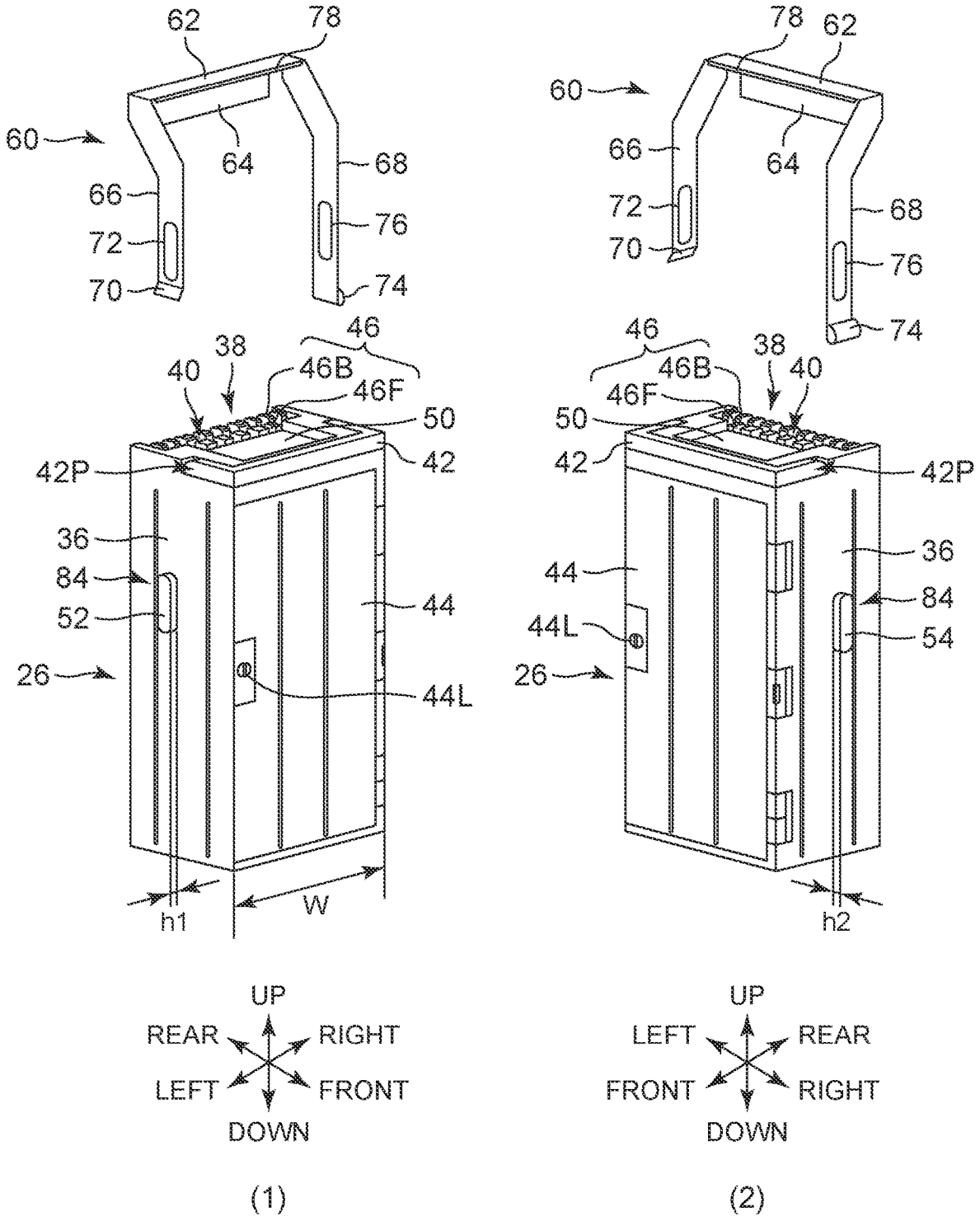
FIG. 4 is a perspective view illustrating a configuration of the banknote cassette and a protector when the protector is in a non-attached state, according to the first embodiment.

As illustrated in FIG. 4, each banknote cassette 26 is configured mainly by a cassette casing 36 forming an outer portion (that is, an outward profile) of each banknote cassettes. The cassette casing 36 is formed overall in a rectangular block shape that is long in the up-down direction and relatively short in the front-rear direction. Incidentally, the cassette casing 36 is configured by combining several molded parts made of predetermined resin materials, of gray or cream color, for example.

A front-rear direction length and a left-right direction length of the cassette casing 36 are slightly shorter than each banknote cassette loading space 17S (FIG. 3). Specifically, the left-right direction length of the cassette casing 36 is a cassette width w. On the other hand, the front-rear direction length of the cassette casing 36 is longer than the right side plate 31 (FIG. 3).

A cassette guidance portion 38 that hands over banknotes is provided at a position toward the rear of an upper surface of the cassette casing 36. An elongated slit shaped insertion hole 40 with its length direction along the left-right direction is provided at the cassette guidance portion 38. The cassette guidance portion 38 allows proceeding of banknotes in the up-down direction, and allows the banknotes to be moved between the interior and the exterior of the cassette casing 36, in a state in which the length direction of banknotes runs along from left to right, and the sheet surfaces of the banknotes face the front and rear. When the lower frame 17 loaded with the banknote cassettes 26 is stored in the pay-in/pay-out device casing 11 (FIG. 2), the cassette guidance portion 38 passes banknotes between the cassette guidance portion 38 and the conveyance section 23 that is positioned at an upper side of the handover sections 28 via the handover sections 28.

Figure 7:
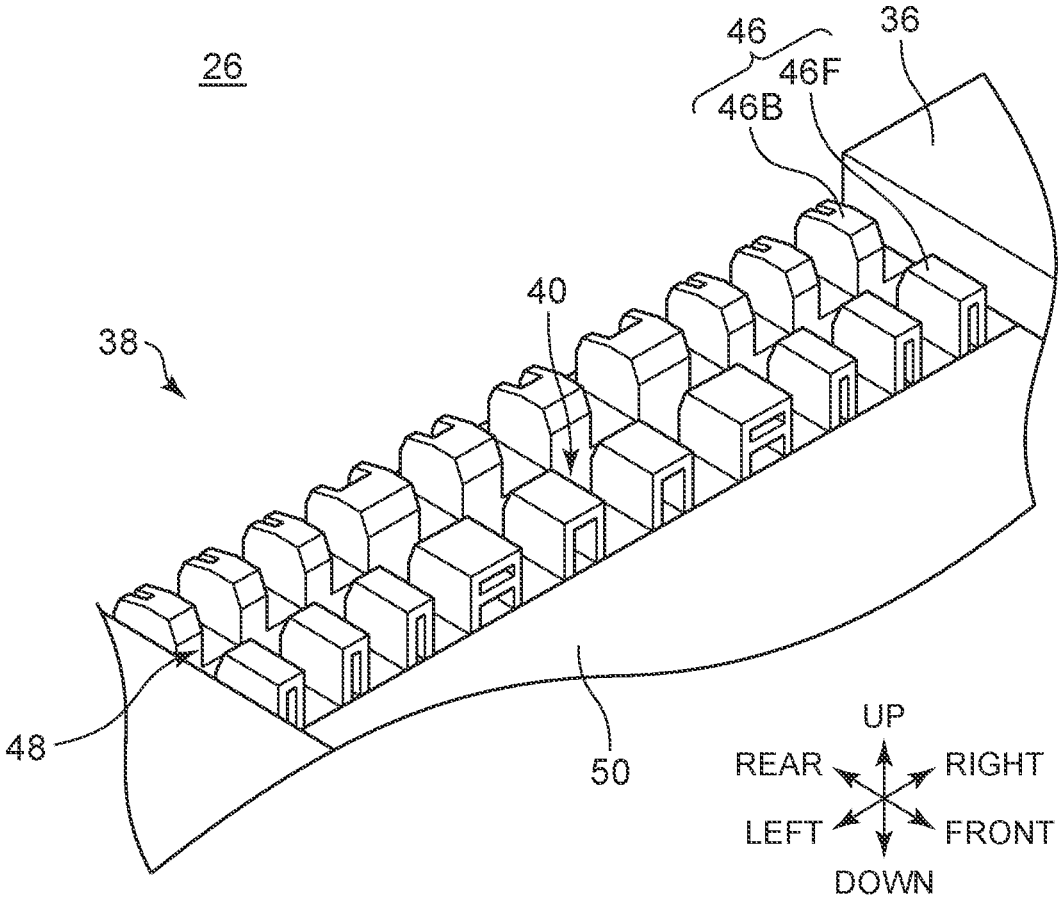
FIG. 7 is perspective view illustrating a configuration of a cassette guide portion of the banknote cassette.

As illustrated in FIG. 7, the cassette handover guide 46 is provided at the cassette guidance portion 38. The cassette handover guide 46 is configured by a front cassette handover guide 46F disposed on the front side and including finger bodies arranged discretely in the left-right direction and a rear cassette handover guide 46B disposed at the rear side and including other finger bodies arranged discretely in the left-right direction. The cassette rear handover guide 46B is positioned at an upper end of a rear side surface of the cassette casing 36. A conveyance space 48, configured by a predetermined space (for example, 5 mm) is formed between the front cassette handover guide 46F and the rear cassette handover guide 46B. The conveyance space 48 configures a conveyance path along which banknotes are conveyed along the vertical direction with sheet surfaces of the banknotes facing the front and rear directions. The conveyance space 48 is provided between the insertion hole 40 of the cassette casing 36 and the exterior of the cassette casing 36, and guides one surface and the other surface of conveyed banknotes. The front side of the cassette handover guide 46 is covered with an upper cover 50 that covers an upper surface of each banknote cassette 26.

Figure 5:
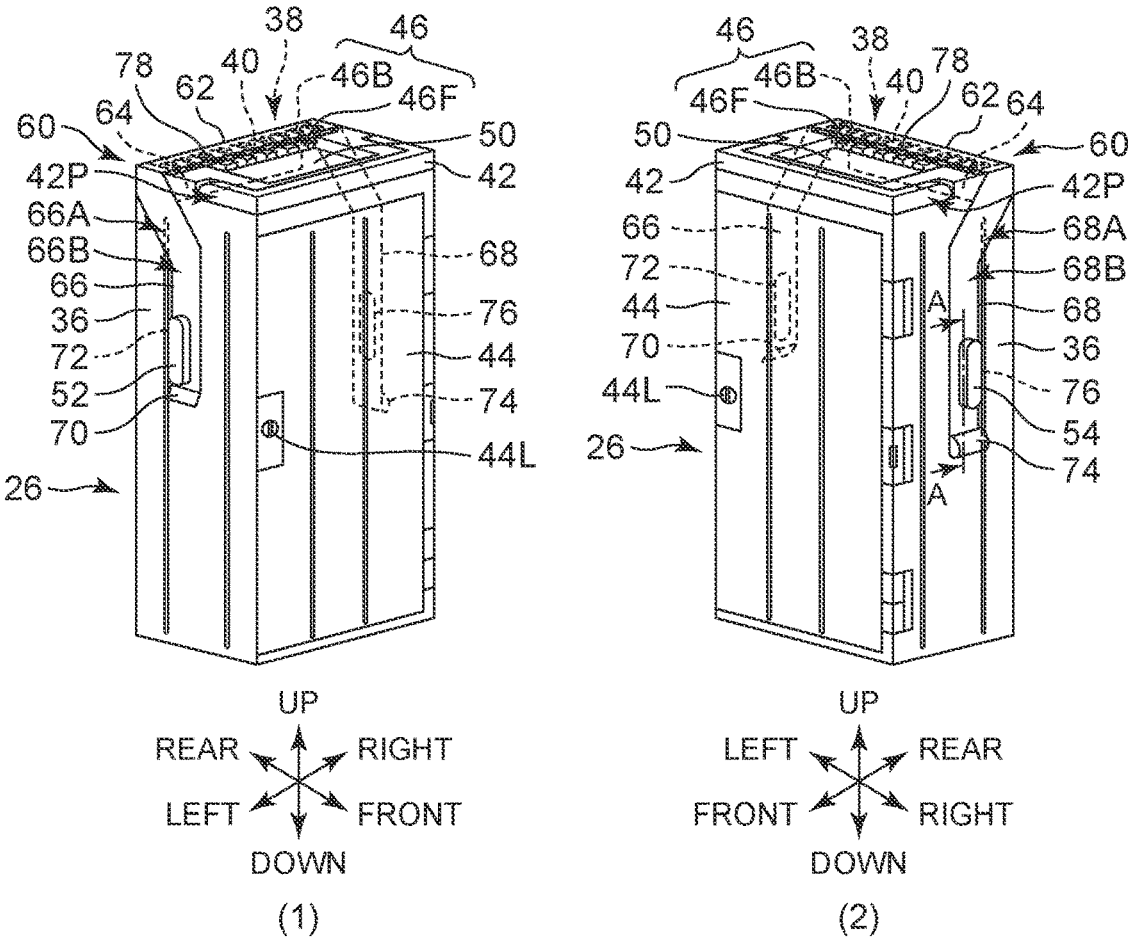
FIG. 5 is perspective view illustrating a configuration of the banknote cassette and the protector when a handle of the cassette is in non-using state and the protector is in an attached state, according to the first embodiment.
Figure 6:
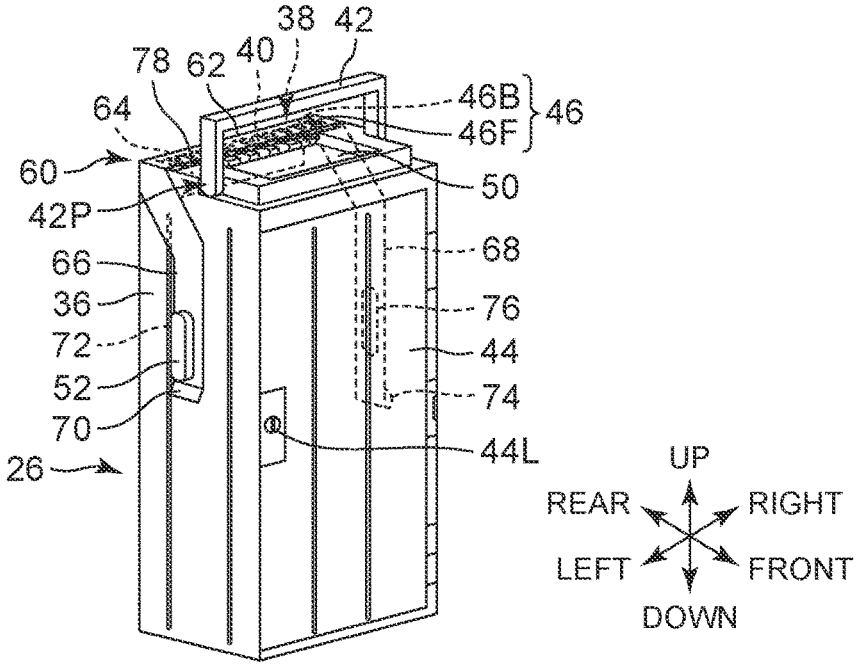
FIG. 6 is a perspective view illustrating a configuration of the banknote cassette and the protector the handle is in a use state and the protector is in an attached state, according to the first embodiment.

As illustrated in FIG. 6, in the front of the upper surface of the cassette casing 36, an indentation are formed along the outer periphery of a front side and both left and right sides of the cassette casing 36, and a handle 42 is attached so as to fit into the indentation. As illustrated in FIG. 4 and FIG. 5, the handle 42 is formed overall in a U-shape by a portion extending a left-right direction positioned at the front side of each banknote cassette, and a portion extending a front-rear direction positioned at both left and right sides of each banknote cassette. Further, in a middle vicinity of the front-rear direction in portions of both the left and the right sides of the cassette casing 36, the handle 42 is attached to the cassette casing 36 through a specific rotation axis 42P. Thus, the handle 42 is stored in the indentation of the cassette casing 36 as illustrated in FIG. 4 and FIG. 5 when not in use. On the other hand, the portion extending in the left-right direction of the handle 42 is pulled upward from the cassette casing 36 by rotationally moving the handle 42 rearward and upward as illustrated in FIG. 3 and FIG. 6 by an operator or the like when using the handle 42. Hence, the handle 42 can be easily grasped by the operator or the like. Further, the handle 42 moves rotationally to a front portion which is the opposite direction to rear portion of each banknote cassette 26 provided on the cassette guidance portion 38 in each banknote cassette 26, and is stored to the indentation of the cassette casing 36. Hereinafter, a state in which the handle 42 is pulled upward from the cassette casing 36 as illustrated FIG. 3 and FIG. 6 when the operator grips the handle 42 at the time of use is also referred to as a handle using state, and a state in which the handle 42 is stored to the indentation of the cassette casing 36 as illustrated in FIG. 4 and FIG. 5 when not using is also referred to as a handle non-using state.

A front door 44 is provided in the front surface of the cassette casing 36. The front door 44 opens and closes by moving rotationally about a hinge provided in the vicinity of a right end in the front door 44. The cassette casing 36 is able to access a storage space formed inside the cassette casing 36 when the front door 44 is opened. Further, the cassette casing 36 prohibits access to an internal space from outside when the front door 44 is closed. Further, the front door 44 is provided with a lock 44L which can be unlocked by a predetermined key. The cassette casing 36 prohibits the opening of the front door 44 by being locked with the lock 44L while closing the front door 44, and allows the opening of the front door 44 only when the lock 44L is unlocked.

In a right side surface of the cassette casing 36, one non-maintenance side protrusion 54 that protrudes slightly to the right side from the surroundings is provided at the substantial center in the front-rear direction and slightly upper side of the center in the vertical direction. The non-maintenance side protrusion 54 is formed in a vertical elongated shape in a straight line extending in the vertical direction, and is a rectangular shape with rounded corners in a right side view. Further, the non-maintenance side protrusion 54 is fitted into a notch as a positioning portion (not illustrated in the drawings) in the right side plate 31 of the lower frame 17 (FIG. 3), and is fitted into the non-maintenance side hole 76 of the protector 60 described later. A height of a left-right direction of the non-maintenance side protrusion 54 that protrudes in a rightward direction from the right side surface of the cassette casing 36 is a non-maintenance side protrusion height h2.

In a left side surface of the cassette casing 36, one maintenance side protrusion 52 that protrudes slightly to the left side from the surroundings is provided at substantially the center in the front-rear direction. The maintenance side protrusion 52 is provided such that the position in the vertical direction of the maintenance side protrusion 52 is higher than the non-maintenance side protrusion 54. The maintenance side protrusion 52 is formed in a vertical elongated shape in a straight line extending in the vertical direction, and is a rectangular shape with rounded corners in a left side view. Further, the maintenance side protrusion 52 is fitted into a notch as a positioning portion (not illustrated in the drawings) in the left side plate 30 of the lower frame 17 (FIG. 3), and is fitted into a maintenance side hole 72 of the protector 60 described later. A height of a left-right direction of the maintenance side protrusion 52 that protrudes a leftward direction from the left side surface of the cassette casing 36 is a maintenance side protrusion height h1. Hereinafter, the maintenance side protrusion 52 and non-maintenance side protrusion 54 are also referred to collectively as a fitting portion 84.

1-5. Configuration of the Protector

Figure 8:
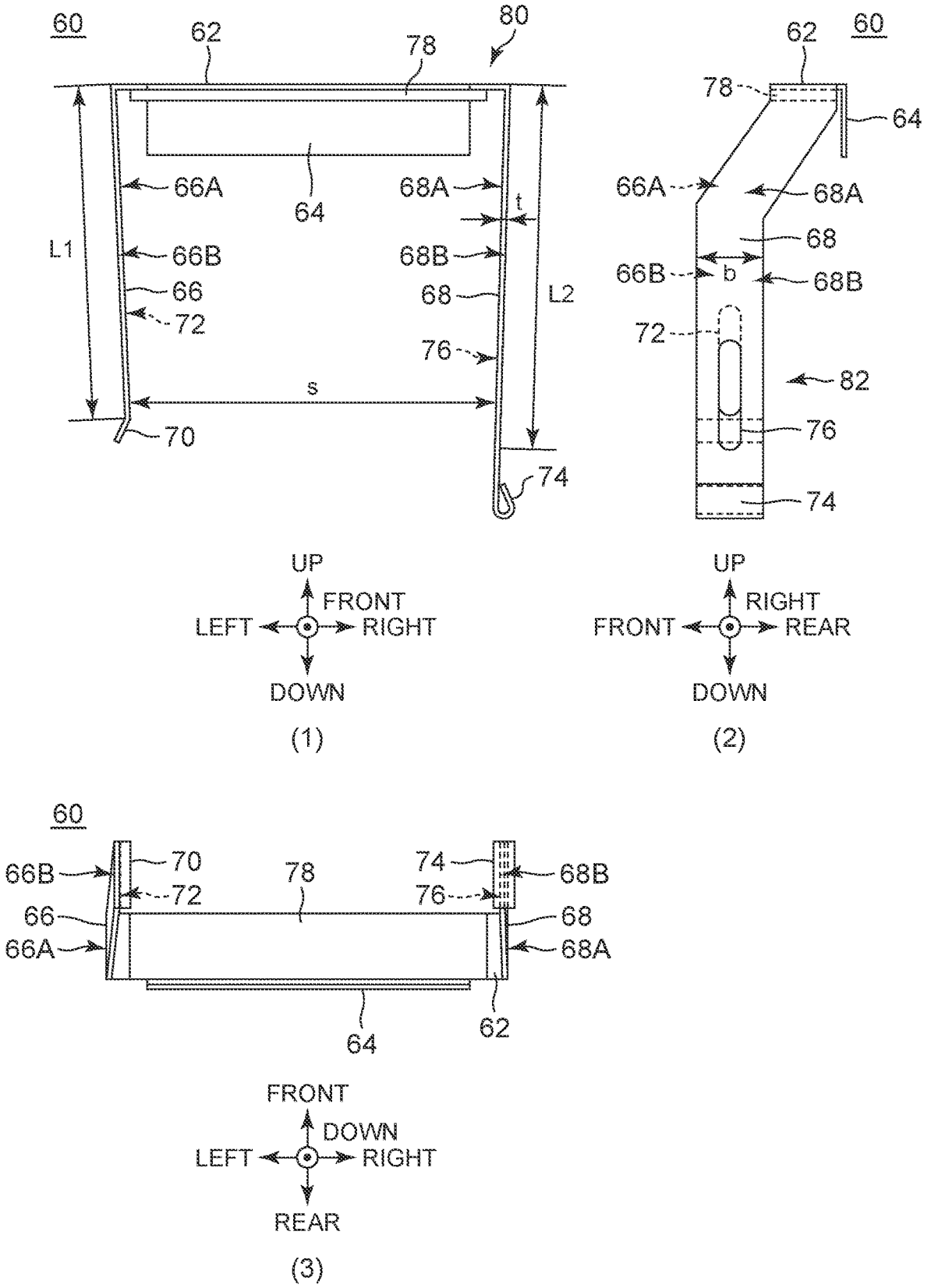
FIG. 8 is a three-plane diagram illustrating a configuration of the protector according to the first embodiment.

Each banknote cassette 26 is transported while the protector 60 illustrated in FIG. 4, FIG. 5 and FIG. 6 is attached to the cassette casing 36 when banknotes are supplemented and recovered. Hereinafter, a state in which the protector 60 is attached to each banknote cassette 26 is also referred to as a protector attached state, and a state in which the protector 60 is detached from each banknote cassette 26 is also referred to as a protector non-attached state. As illustrated in FIG. 8, the protector 60 is formed in an overall U-shape, and an upper surface portion 62, a rear surface portion 64, a maintenance side arm 66, and a non-maintenance side arm 68 are formed by bending one steel plate.

The upper surface portion 62 is formed such that a length in a left-right direction is slightly longer than the cassette casing 36 and a length in a front-rear direction covers the cassette guidance portion 38 of each banknote cassette 26 from above. The upper surface portion 62 covers the cassette guidance portion 38 from above in the protector attached state, and thereby protects the cassette handover guide 46 of the cassette guidance portion 38 and prevents damage to the cassette handover guide 46.

The rear surface portion 64 is formed by bending the steel plate from a rear end of the upper surface portion 62 at right angle downward from the vicinity of the right end to the vicinity of the left end, thereby maintaining the rigidity of the upper surface portion 62. Further, the rear surface portion 64 is formed such that its length in a vertical direction covers the rear cassette handover guide 46B of the cassette guidance portion 38 in each banknote cassette 26 from the rear. The rear surface portion 64 covers the rear cassette handover guide 46B of the cassette guidance portion 38 from the rear in the protector attached state, and thereby protects the rear cassette handover guide 46B and prevents damage to the rear cassette handover guide 46B.

The maintenance side arm 66, which is a the steel plate, is directed downward from the left end portion of the upper surface portion 62, and is formed by being bent slightly toward the right side than the right angle with respect to the upper surface portion 62 in the protector non-attached state. The maintenance side arm 66 includes a rotation axis retracting portion 66A that linearly extends forward as it goes downward from a left end portion of the upper surface portion 62 and a cassette fixing portion 66B that linearly extends downward from a lower end portion of the rotation axis retracting portion 66A along the vertical direction. In the lower end of the maintenance side arm 66, a diagonal bend 70 that bends so as to linearly extend leftward as it goes downward is formed. In the cassette fixing portion 66B of the maintenance side arm 66, the maintenance side hole 72 is drilled at a position facing the maintenance side protrusion 52 of each banknote cassette 26 in the protector attached state (FIG. 5). The maintenance side hole 72 and the maintenance side protrusion 52 of each banknote cassette are the same shape in left side view. The maintenance side hole 72 is formed in a vertical elongated shape in a straight line that extends in the vertical direction, and is a rectangular shape with rounded corners. The maintenance side hole 72 is fitted into the maintenance side protrusion 52 of each banknote cassette 26 substantially without any gap in the protector attached state, thereby fixing the protector 60 to each banknote cassettes 26.

The non-maintenance side arm 68, which is a steel plate, is directed downward from the right end portion of the upper surface portion 62, and is formed by being bent slightly than the right angle toward the left side with respect to the upper surface portion 62 in the protector non-attached state. Further, the non-maintenance side arm 68 is formed to be longer than the maintenance side arm 66. The non-maintenance side arm 68 includes a rotation axis retracting portion 68A that linearly extends forward as it goes downward from a right end portion of the upper surface portion 62 and a cassette fixing portion 68B that linearly extends downward from a lower end portion of the rotation axis retracting portion 68A in the vertical direction. A J-shaped bend 74 that bends in a J-shape to the right is formed in the lower end of the non-maintenance side arm 68. In the J-shaped bend 74, when each banknote cassette 26 is about to load into each banknote cassette loading space 17S (FIG. 3) in the protector attached state, a height of the left-right direction protruding the right direction from the cassette fixing portion 68B is such that the J-shaped bend 74 abuts the right side plate upper end surface 31U. In the cassette fixing portion 68B of the non-maintenance side arm 68, the non-maintenance side hole 76 is drilled at position facing the non-maintenance side protrusion 54 in the protector attached state (FIG. 5). The non-maintenance side hole 76 and the non-maintenance side protrusion 54 of each banknote cassette have the same shape in right side view. The non-maintenance side hole 76 is formed in a vertical elongated shape in a straight line that extends in the vertical direction, and is a rectangular shape with rounded corners. The non-maintenance side hole 76 is fitted into the non-maintenance side protrusion 54 of each banknote cassette 26 substantially without any gap in the protector attached state, thereby fixing the protector 60 to each banknote cassettes 26.

Thus, in the protector 60, the diagonal bend 70 and the J-shaped bend 74 that bends outward in the left-right direction as it goes downward (that is, bends so as to be away from the left side surface and the right side surface of the cassette casing 36 in the protector attached state) are respectively formed at the lower end of the maintenance side arm 66 and the non-maintenance side arm 68. Thus, in the protector 60, a space between the lower end portions of the maintenance side arm 66 and the non-maintenance side arm 68 spreads as it goes downward. Therefore, the operator can easily attach the protector 60 to each banknote cassette 26 from above. Hereinafter, the maintenance side arm 66 and the non-maintenance side arm 68 are also referred to collectively as an arm portion 80, and the maintenance side hole 72 and the non-maintenance side hole 76 are also referred to collectively as a fitting portion 82.

In a bottom surface of the upper surface portion 62 facing the cassette handover guide 46 (FIG. 7) in the protector attached state, a cushion 78 as a buffer material is adhered to substantially the entire the bottom surface of the upper surface portion 62. The cushion 78 has a thickness of about 5 mm in a normal state in which it is not squashed, and abuts the cassette handover guide 46 in the protector attached state.

An arm portion space s which is the space in the left-right direction between the maintenance side arm 66 and the non-maintenance side arm 68 in the protector non-attached state is narrower than a cassette width w which is a width of the left-right direction of the cassette casing 36 (FIG. 4).

Even if the arm portion space s is larger than (maintenance side protrusion height h1+cassette width w+non-maintenance side protrusion height h2) (FIG. 4) by spreading the lower end portion of the maintenance side arm 66 and the non-maintenance side arm 68 when the protector 60 is attached to each banknote cassette 26, a plate thickness t (FIG. 8) of the steel plate in the protector 60 is such that the protector 60 is not plastically deformed.

An arm portion width b that is the width in the front-rear direction of the cassette fixing portion 66B of the maintenance side arm 66 and the cassette fixing portion 68B of the non-maintenance side arm 68 is set such that sufficient reaction force may be obtained in a state where tips of the maintenance side arm 66 and the non-maintenance side arm 68 are elastically deformed outward in the left-right direction and spread such that the arm portion space s is wider than a cassette width w.

A maintenance side arm length L1 which is a distance from the upper surface of the upper surface portion 62 in the maintenance side arm 66 to the lower end of the maintenance side hole 72 and a non-maintenance side arm length L2 which is a distance from the upper surface of the upper surface portion 62 in the non-maintenance side arm 68 to the lower end of the non-maintenance side hole 76 are set such that the cushion 78 that abuts the cassette handover guide 46 in the protector attached state is crushed by about 2 mm.

The protector 60 in the protector attached state sandwiches the right side surface and the left side surface of the cassette casing 36 (FIG. 5) by the maintenance side arm 66 and the non-maintenance side arm 68. The non-maintenance side hole 76 and the maintenance side hole 72 respectively fit into the non-maintenance side protrusion 54 and the maintenance side protrusion 52, and therefore the protector 60 is fixed to each banknote cassette 26. The protector 60 in the protector attached state presses the cushion 78 against to the cassette handover guide 46. Moreover, although the protector 60 tries to move upward from the cassette casing 36 in order for the cushion 78 to return to the normal state, the lower end portion of the non-maintenance side hole 76 and the lower end portion of the maintenance side hole 72 respectively catch the non-maintenance side protrusion 54 and the maintenance side protrusion 52, whereby the upward movement of the protector 60 is restricted.

Therefore, the protector 60 covers the cassette handover guide 46 of each banknote cassette 26 with a high rigid upper surface portion 62 in the protector attached state, and further presses cushion 78 against to the cassette handover guide 46, thereby preventing damage to the cassette handover guide 46 by an impact from the outside.

Moreover, as illustrated in FIG. 5, the protector 60 extends rearward from the upper end of the cassette fixing portion 66B and the cassette fixing portion 68B in the protector attached state such that the rotation axis retracting portion 66A and the rotation axis retracting portion 68A avoid a rotation axis 42P of the handle 42. Moreover, the protector 60 is attached to each banknote cassette 26 so as to prevent from interference with a rotation trajectory of the handle 42 that rotates between the handle using state (FIG. 6) and the handle non-using state (FIG. 5). Thus, the protector 60 prevents interference with the handle 42 when the operator grasps the handle 42 and transports each banknote cassette 26, and therefore the movement of the handle 42 is not disturbed.

1-6. Installation and Removal of Protector

The protector 60 is attached to the banknote cassettes 26 when each of banknote cassettes 26 is transported. More specifically, when the operator performs a banknote supplement operation, the operator attaches the protector 60 to each banknote cassette 26 storing banknotes and carries each banknote cassette 26 to the ATM 1, and when the operator performs a banknote recovering operation, the operator attaches the protector 60 to each banknote cassette 26 and takes each banknote cassette back from the ATM 1.

The protector 60 is attached to the each of banknote cassettes 26 from above each of the banknote cassettes 26. When the protector 60 is attached to each banknote cassette 26, in the protector 60, the lower end portion of the maintenance side arm 66 is elastically deformed by the operator to the left side from a state illustrated in FIG. 8, or the lower end portion of the non-maintenance side arm 68 is elastically deformed to the right side from the state illustrated in FIG. 8, thereby moving downwards from above each banknote cassette 26 toward each banknote cassette 26.

Figure 9:
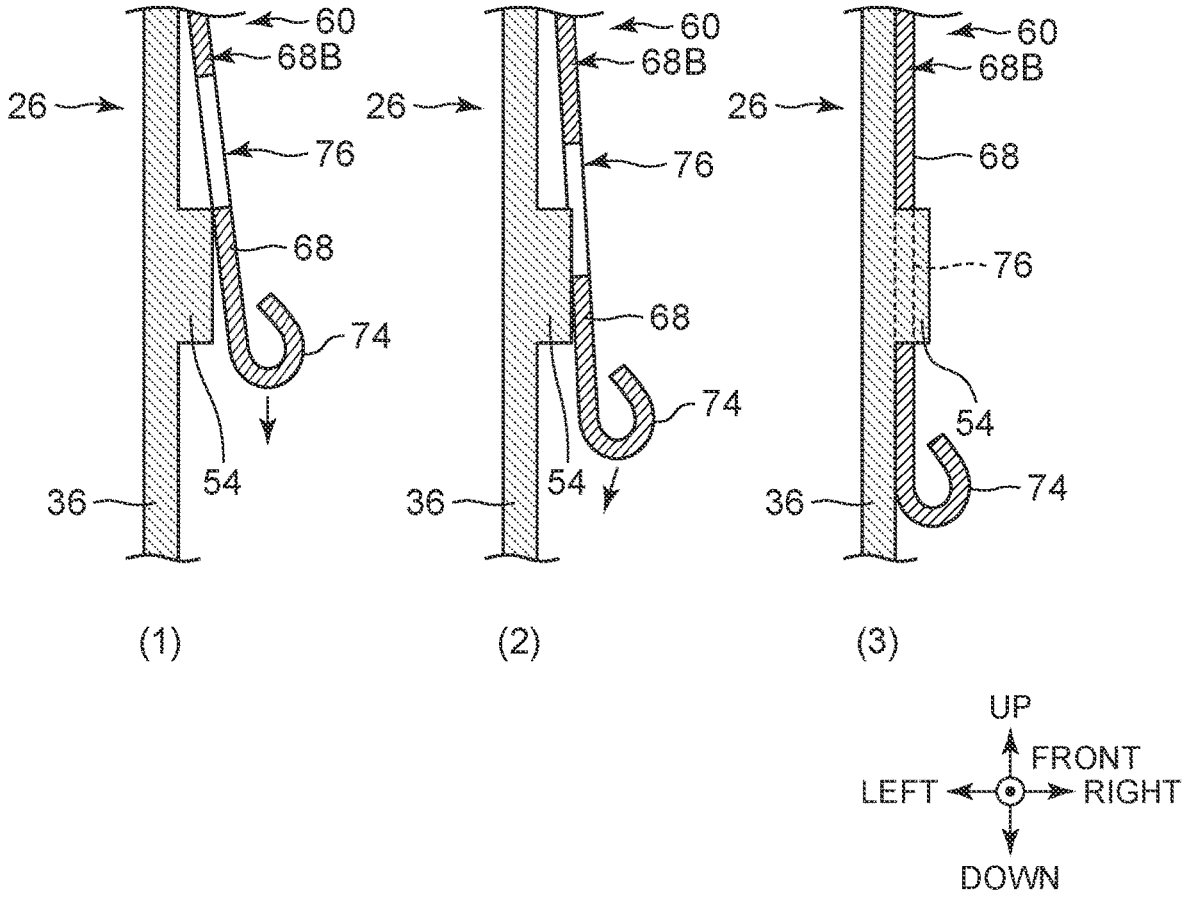
FIG. 9 is a sectional view in the direction of the arrows A-A illustrated in FIG. 5, illustrating a state in which the protector is attached to the banknote cassette.

As illustrated in FIG. 9(1), the protector 60 moves downward while the cassette fixing portion 68B of the non-maintenance side arm 68 gets over the non-maintenance side protrusion 54 of each banknote cassette 26. Subsequently, as illustrated in FIG. 9(2), the upper end portion of the non-maintenance side protrusion 54 of each banknote cassette 26 enters the lower end portion of the non-maintenance side hole 76 of the non-maintenance side arm 68. When the protector 60 further moves downwards, as illustrated in FIG. 9(3), the entire non-maintenance side protrusion 54 of each banknote cassette 26 is fitted into the non-maintenance side hole 76 of the non-maintenance side arm 68, and therefore the left side surface of the non-maintenance side arm 68 abuts the right side surface of the cassette casing 36.

The case described above is one in which the non-maintenance side hole 76 of the protector 60 is fitted into the non-maintenance side protrusion 54 of each banknote cassette 26. However, it is substantially the same also in the case where the maintenance side hole 72 of the protector 60 is fitted into the maintenance side protrusion 52 of each banknote cassette 26. Therefore, the non-maintenance side hole 76 is fitted into the non-maintenance side protrusion 54 and the maintenance side hole 72 is fitted into the maintenance side protrusion 52, and therefore the protector 60 is fixed to each banknote cassette 26.

The protector 60 is respectively formed with the diagonal bend 70 and the J-shaped bend 74 at the lower end of the maintenance side arm 66 and non-maintenance side arm 68, and therefore the maintenance side protrusion 52 and the non-maintenance side protrusion 54 smoothly fit in the maintenance side hole 72 and the non-maintenance side hole 76, respectively. Moreover, the maintenance side hole 72 and the maintenance side protrusion 52 are formed with each other in the vertically elongated shape, and the non-maintenance side hole 76 and the non-maintenance side protrusion 54 are formed with each other in the vertically elongated shape. Therefore, the protector 60 is unlikely to collapse in a front-rear direction in the protector attached state.

Moreover, in order to enable handover of banknotes between each banknote cassette 26 and the conveyance section 23 in a state where each banknote cassette 26 is loaded to each banknote cassette loading space 17S, the protector 60 needs to detach from each banknote cassette 26 when each banknote cassette 26 is about to load to each banknote cassette loading space 17S. In the protector 60, the lower end portion of the maintenance side arm 66 is elastically deformed to the left side by the operator, and the lower end portion of the non-maintenance side arm 68 is elastically deformed to the right side by the operator, and therefore the maintenance side protrusion 52 and the non-maintenance side protrusion 54 are respectively detached from the maintenance side hole 72 and the non-maintenance side hole 76. Accordingly, the protector 60 is detached from each banknote cassette 26.

1-7. Loading of Each Banknote Cassette

When each banknote cassette 26 is loaded to each banknote cassette loading space 17S of the lower frame (FIG. 3), each banknote cassette 26 gradually descends from a state positioned substantially directly above each banknote cassette loading space 17S by the operator or the like, and therefore is loaded to the inside of each banknote cassette loading space 17S from the lower side of each banknote cassette 26. When this is performed, the non-maintenance side protrusion 54 and the maintenance side protrusion 52 respectively fit notches, not illustrated in the drawings, of the right side plate 31 and the left side plate 30 of the lower frame 17, and each banknote cassette 26 is positioned with respect to the lower frame 17 by positioning means, not illustrated in the drawings, of the upper end portion side in the right side plate 31.

Figure 10:
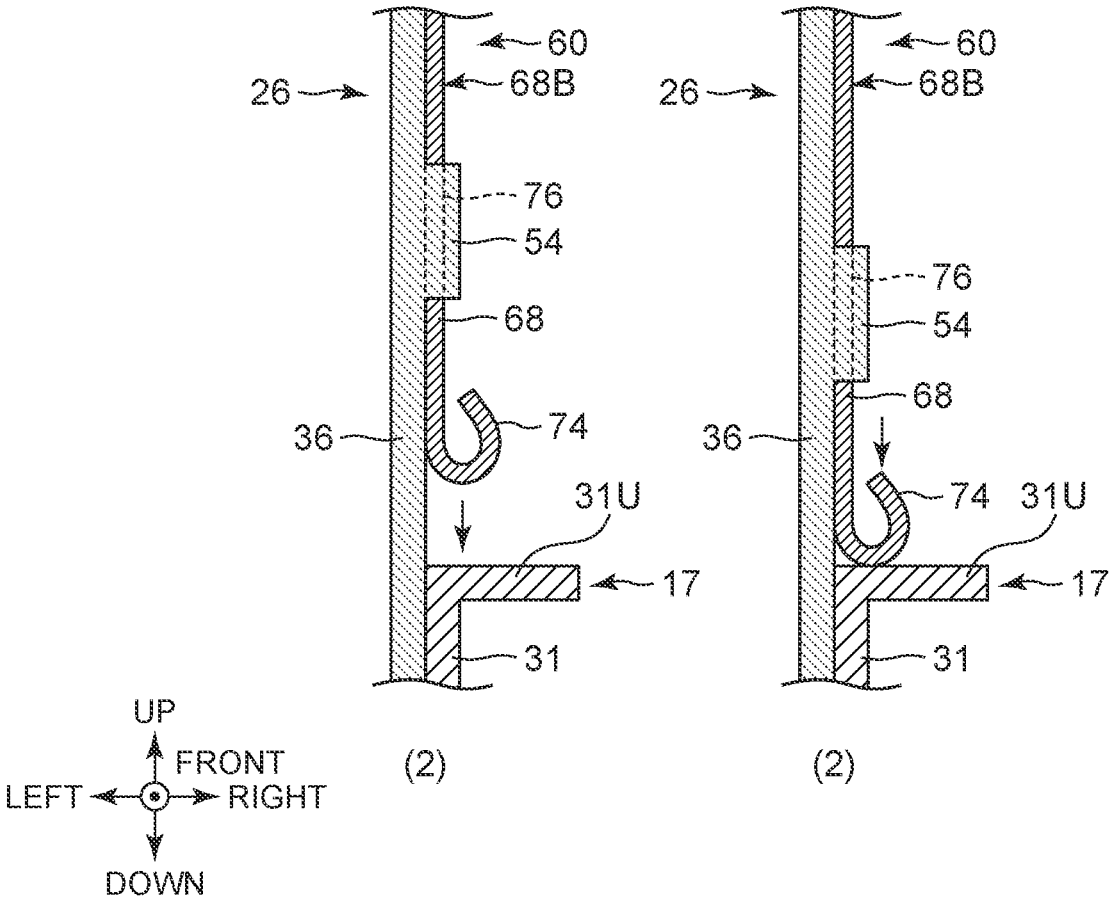
FIG. 10 is a sectional view in the direction of the arrow A-A illustrated in FIG. 5, illustrating a state in which the banknote cassette is being loaded into a banknote cassette loading space.

As illustrated in FIG. 10(1), when each banknote cassette 26 is about to load to each banknote cassette loading space 17S in the protector attached state, each banknote cassette 26 descends in a state in which the J-shaped bend 74 is positioned above of the right side plate upper end surface 31U of the lower frame 17. As illustrated in FIG. 10(2), when each banknote cassette 26 further descends toward each banknote cassette loading space 17S, the J-shaped bend 74 abuts the right side plate upper end surface 31U of the lower frame 17, thereby restricting the further downward movement of each banknote cassette 26. Accordingly, the protector 60 prevents each banknote cassette 26 from being loaded to each banknote cassette loading space 17S in the protector attached state, and may cause the operator to realize that each banknote cassette 26 is about to load to each banknote cassette loading space 17S in the protector attached state.

1-8. Effects

In the protector 60 with the above configuration, the cassette handover guide 46 is configured to be covered by the upper surface portion 62, when the protector 60 is attached to the cassette casing 36. Accordingly, the upper surface portion 62 of the protector 60 may prevent the cassette handover guide 46 from abutting with the outside, thereby protecting the cassette handover guide 46 from damage.

Moreover, in the protector 60, the arm portion 80 extending from the right end and the left end of the upper surface portion 62 so as to face the right side surface and the left side surface of the cassette casing 36 sandwiches the cassette casing 36, and the fitting portion 82 is fitted to the fitting portion 84 of the cassette casing 36. Accordingly, the protector 60 is stably fixed to the cassette casing 36, and the protector 60 may not be easily detached from the cassette casing 36.

Moreover, in the protector attached state, the upper surface portion 62 of the protector 60 covers the cassette handover guide 46, and the protector 60 is configured to press the cushion 78 against the cassette handover guide 46. Accordingly, in the protector 60, the cushion 78 may buffer an impact between the cassette handover guide 46 and the upper surface portion 62, thereby further protecting the cassette handover guide 46 from damage as compared with the case where only the upper surface portion 62 faces to the cassette handover guide 46.

Further, in the protector 60, the arm portion 80 is bent so as to avoid the handle 42 when the protector 60 is attached to the cassette casing 36, therefore the protector 60 is prevented from interfering with the trajectory of movement of the handle 42. Accordingly, the protector 60 is prevented from interfering with the handle 42 when the operator grasps the handle 42 and transports the banknote cassettes 26, and therefore the protector 60 may not prevent the movement of the handle 42.

Further, the protector 60 is bent such that a lower end portion of the arm portion 80 moves away from the right side surface and the left side surface of the cassette casing 36, that is, the space spreads from upward toward the lower end portion. Accordingly, the protector 60 may be easily attached to the banknote cassettes 26 by the operator. Moreover, the protector 60 has a U-shape, and therefore may easily be detached from the banknote cassettes 26 by the operator by being elastically deformed such that the tip of the arm portion 80 is spread.

Moreover, the protector 60 is formed by bending one piece of sheet metal. Therefore, the protector 60 may be easily manufactured as compared with the case where sheet metals are joined, for example, by welding.

Further, in the protector 60, the J-shaped bend 74 abuts the right side plate upper end surface 31U of the lower frame 17 when the banknote cassettes 26 are about to load to the banknote cassette loading spaces 17S in the protector attached state, thereby restricting the further downward movement of each banknote cassette 26. Accordingly, in the protector 60, it is possible to prevent forgetting to detach the protector 60 from each banknote cassette 26 when each banknote cassette 26 is loaded to the lower frame 17.

Moreover, the protector 60 is configured to abut the J-shaped bend 74 to the right side plate upper end surface 31U originally provided on the right side plate 31 in order to secure the strength of the right side plate 31 of the lower frame 17. Therefore, the right side plate upper end surface 31U may be used without separately forming a surface at the right side plate 31 which contacts the J-shaped bend 74 of the protector 60. Hence, it is possible not to complicate the configuration of the lower frame 17.

Moreover, in order to prevent each banknote cassette 26 from being wrongly loaded into each banknote cassette loading space 17S in the left-right reversed state, in the protector 60, the maintenance side hole 72 and the non-maintenance side hole 76 are respectively configured to fit to the maintenance side protrusion 52 and the non-maintenance side protrusion 54 originally provided in the cassette casing 36. Thus, the maintenance side protrusion 52 and the non-maintenance side protrusion 54 may be used without separately forming protrusions on the cassette casing 36 that fit into the maintenance side hole 72 and the non-maintenance side hole 76 of the protector 60. Hence, it is possible not to complicate the configuration of the cassette casing 36.

According to the above configuration, the ATM 1 is provided with a cassette casing 36 that is configured so as to be attachable to and detachable from the banknote cassette loading spaces 17S as a casing loading space formed in the lower frame 17 as a predetermined frame, and that forms the storage space for storing therein banknotes to be dispensed to users or that have been deposited by the users and an insertion hole 40 as an opening 40 allowing banknotes from the outside to be stored in the internal storage space or fed to the outside from the storage space, and the protector 60 that is attachable to the cassette casing 36, and which has an upper surface portion 62 that covers the insertion hole 40 when the protector is attached to the cassette casing 36, and an arm portion 80 that extends from both ends of the upper surface portion 62 so as to face both right and left side surfaces of the cassette casing 36 and in which a fitting portion 82 to fit a fitting portion 84 formed on both side surfaces of the cassette casing 36 are formed.

Accordingly, in the ATM 1, the protector 60 is attached to the cassette casing 36 such that the upper surface portion 62 covers the cassette handover guide 46 when each banknote cassette 26 is transported, thereby preventing damage to the cassette handover guide 46 by an impact from the outside.

2. Second Exemplary Embodiment

2-1. Configuration of Protector

Figure 11:
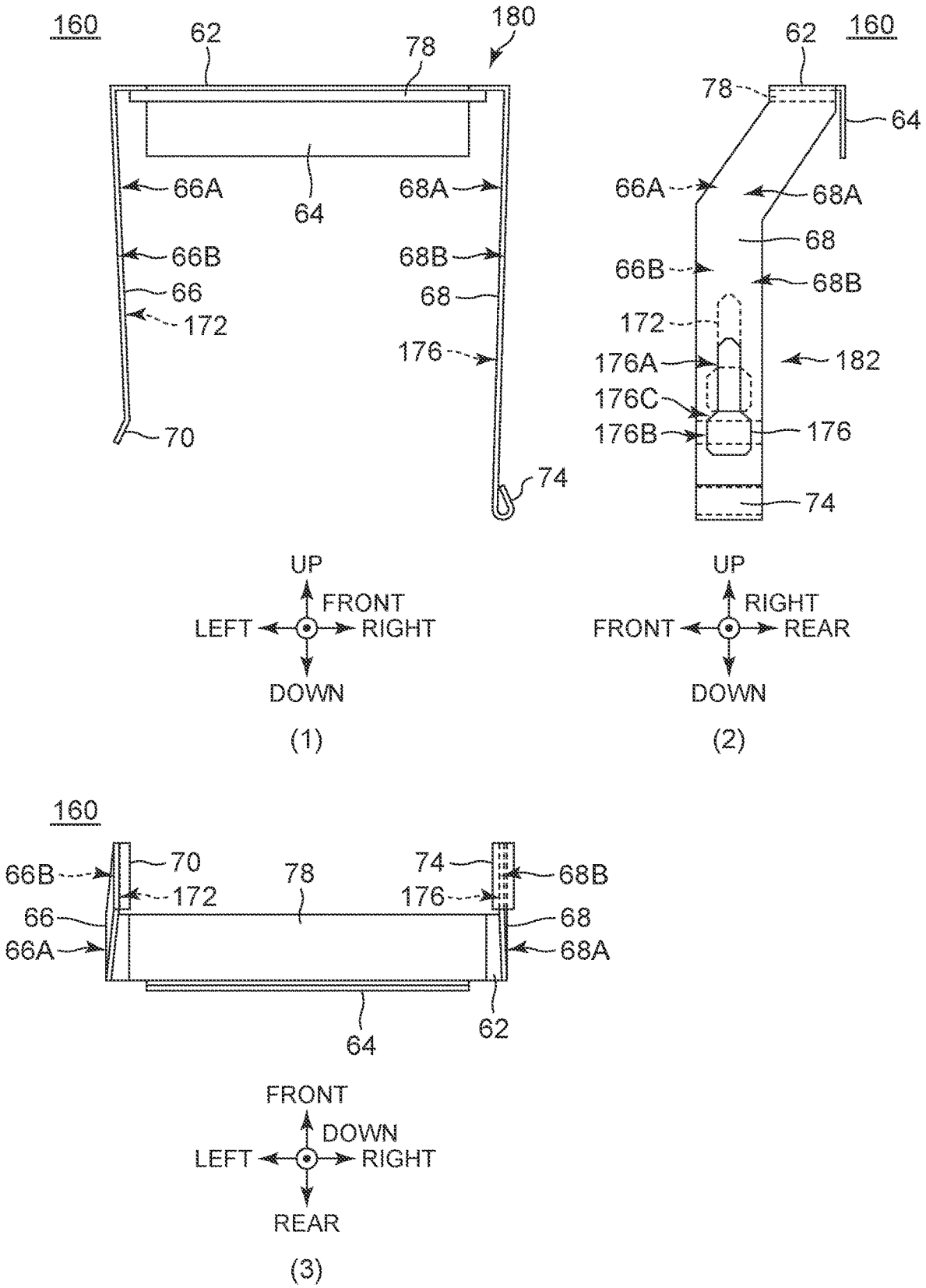
FIG. 11 is a three-plane diagram illustrating a configuration of the protector according to a second embodiment.

As compared with the protector 60 of the first exemplary embodiment, a protector 160 according to a second exemplary embodiment is structured similarly except for an arm portion 180 differing from the arm portion 80, as illustrated FIG. 11 in which the same reference numerals are given to members corresponding to FIG. 8. As compared with the arm portion 80, the arm portion 180 is structured similarly except for a fitting portion 182 differing from the fitting portion 82. At the fitting portion 182, as compared with the fitting portion 82, a maintenance side hole 172 and a non-maintenance side hole 176 differ from the maintenance side hole 72 and the non-maintenance side hole 76, respectively.

Since the maintenance side hole 172 and the non-maintenance side hole 176 have the same shape, only the non-maintenance side hole 176 will be described below. The non-maintenance side hole 176 includes a fitting portion 176A formed with the same width as that in a front-rear direction of the non-maintenance side hole 76 (FIG. 8) at an upper end portion, a width wide portion 176B wider in the front-rear direction than the width of the fitting portion 176A at a lower end portion, and an inclined portion 176C in which the width in the front-rear direction is narrowed gradually from the width wide portion 176B to the fitting portion 176A.

When the protector 160 is attached to each banknote cassette 26, the upper end portion of the non-maintenance side protrusion 54 of the banknote cassette 26 enters the width wide portion 176B of the non-maintenance side hole 176 of the non-maintenance side arm 68. Since the width wide portion 176B is wider in the front-rear direction than the non-maintenance side protrusion 54, the protector 160 can make it easier for the maintenance side protrusion 54 to enter into the non-maintenance side hole 176 than can the protector 60. Further, when the protector 160 moves downward, the upper end portion of the non-maintenance side protrusion 54 of each banknote cassette 26 enters into the fitting portion 176A while being guided in the front-rear direction to a position by the front-rear ends of the inclined portion 176C in the non-maintenance side hole 176 of the non-maintenance side arm 68. Subsequently, the protector 160 is fixed to each banknote cassette 26 by entry of the upper end portion and a center portion of the non-maintenance side protrusion 54 into the fitting portion 176A of the non-maintenance side hole 176.

Thus, in the protector 160, the width wide portion 176B having a wider width in the front-rear direction than the fitting portion 176A is formed at the lower end portion of the non-maintenance side hole 176, and the inclined portion 176C in which the width in the front-rear direction is gradually narrowed from the width wide portion 176B toward the fitting portion 176A is formed between the fitting portion 176A and the width wide portion 176B. Hence, even if the positions of the non-maintenance side hole 176 and the non-maintenance side protrusion 54 are not exactly matched, it is possible to easily attach the protector 160 to each banknote cassette 26.

The case described above is one in which the non-maintenance side hole 176 of the protector 160 is fitted into the non-maintenance side protrusion 54 of each banknote cassette 26. However, it is substantially the same also in the case where the maintenance side hole 172 of the protector 160 is fitted into the maintenance side protrusion 52 of each banknote cassette 26.

3. Additional Exemplary Embodiment

In the above-described first exemplary embodiment a case is described in which the maintenance side protrusion 52 and the non-maintenance side protrusion 54 are provided at each banknote cassette 26 and the maintenance side hole 72 and the non-maintenance side hole 76 into which the maintenance side protrusion 52 and the non-maintenance side protrusion 54 are respectively fitted are provided at the protector 60. However, the invention is not limited to this. For example, a maintenance side protrusion and a non-maintenance side protrusion may be provided at the protector 60, and a maintenance side hole and a non-maintenance side hole into which a maintenance side protrusion and a non-maintenance side protrusion are respectively fitted may be provided at each banknote cassette 26. This also applies in the second exemplary embodiment.

Further, in the above-described embodiment, the protector 60 or the protector 160 may be provided in one of various conspicuous colors such as yellow in order to prevent forgetting to remove the protector 60 or the protector 160. In that case, since the cassette casing 36 is often gray or cream color by being made of resin, a color different from the cassette casing 36 is preferable.

Further, in the above-described embodiment, a protrusion that protrudes toward upward, may be formed from the upper surface portion 62 of the protector 60 or the protector 160. In that case, when the banknote cassettes 26 in the protector attached state are loaded to the banknote cassette loading spaces 17S and the lower unit 15 is stored to the pay-in/pay-out device casing 11, the protrusion abuts the partitioning portion 11P, for example, and therefore it is possible for the operator to aware that the protector 60 or the protector 160 should be removed from the banknote cassettes 26.

Further, in the above-described embodiment a case is described in which one maintenance side protrusion 52 having a vertically elongated shape fits into one maintenance side hole 72 or one maintenance hole 172. However, the invention is not limited to this. For example, two maintenance side holes may be fitted into two maintenance side protrusions that are circular shape and arranged in vertically or front-rear. This also applies the non-maintenance side protrusion 54 and the non-maintenance side hole 76 or the non-maintenance side hole 176.

Further, in the above-described embodiment a case is described in which the upper end of the left side plate 30 in the lower frame 17 is than the upper end of the right side plate 31 in the lower frame 17. However, the invention is not limited to this. For example, the right side plate 31 and the left side plate 30 may be equal in height, or the left side plate 30 is higher than the right side plate 31.

Further, in the above-described embodiment a case is described in which the non-maintenance side arm 68 is longer than the maintenance side arm 66. However, the invention is not limited to this. For example, the maintenance side arm 66 and the non-maintenance side arm 68 may be equal in length, or the non-maintenance side arm 68 is shorter than the maintenance side arm 66.

Further, in the above-described embodiment a case is described in which the J-shaped bend 74 abuts the right side plate upper end surface 31U when the banknote cassettes 26 in the protector attached state are loaded to the banknote loading spaces 17S. However, the invention is not limited to this. For example, the diagonal bend 70 may be made to abut the left side plate upper end surface 30U.

Further, in the above-described embodiment a case is described in which the J-shaped bend 74 is formed at the lower end of the non-maintenance side arm 68. However, the invention is not limited to this. For example, various shapes that abut the right side plate upper end surface 31U when the banknote cassettes 26 are about to load to the banknote cassette loading spaces 17S in protector attached state may be formed at the lower end of non-maintenance side arm 68.

Further, in the above-described embodiment a case is described in which the protector 60 and 160 are formed by bending one steel plate. However, the invention is not limited to this. For example, the protector may be formed by joining steel plates, or the protector may be resin-molded.

Further, in the above-described embodiment, when the banknote cassettes 26 are about to load to the banknote cassette loading spaces 17S, a label for alerting the operator attention to detach the protector 60 from the banknote cassettes 26 may be affixed to, for example, an upper surface of the upper surface portion 62 of the protector 60 and 160.

Further, in the above-described embodiment a case is described in which the invention is applied to a so-called vertically loaded automatic teller machine 1 that loads the banknote cassettes 26 to the banknote cassette loading spaces 17S by moving the banknote cassettes along a vertically direction with respect to the banknote cassette loading spaces 17S. However, the invention is not limited to this. For example, the invention may be applied to an automatic cash machine of so-called laterally loaded type that loads the banknote cassettes to the banknote cassette loading spaces by moving the banknote cassettes along a front-rear direction or a left-right direction with respect to the banknote cassette loading spaces.

Further, in the above-described embodiment a case is described in which the protector 60 is fixed to each banknote cassette 26 by fitting the non-maintenance side protrusion 54 into the non-maintenance side hole 76 and the maintenance side protrusion 52 into the maintenance side hole 72, respectively. However, the invention is not limited to this. For example, either one of the non-maintenance side hole 76 and non-maintenance side protrusion 54 or the maintenance side hole 72 and the maintenance side protrusion 52 may be omitted.

Further, in the above-described embodiment a case is described in which the invention is applied to the protector 60 and 160 attached to the banknote cassettes 26. However, the invention is not limited to this. For example, the invention may be applied to the protector to be attached to the reject cassette 27.

Further, in the above-described embodiment a case is described in which the invention is applied to the ATM 1 handling banknotes. However, the invention is not limited to this. The invention may be applied to various devices handling various paper sheet shaped media such as, for example, securities, gift vouchers, and cash vouchers, and the like.

Moreover, the invention is not limited to the respective exemplary embodiments and additional exemplary embodiments described above. Namely, the invention encompasses application to exemplary embodiments arising from selected combinations of some or all of the respective exemplary embodiments described above and the other exemplary embodiment described above, and exemplary embodiments arising from extracting parts therefrom.

Further, in the above-described embodiment a case is described in which the protector 60 or the protector 160 as a protector is configured by the upper surface portion 62 as a cover and the arm portion 80 as an attaching portion. However, the invention is not limited to this. The protector may be configured by a cover configured of various other components and an attaching portion.

Further, in the above-described embodiment a case is described in which each banknote cassettes 26 as a medium storage casing is configured by the cassette casing 36 as a medium storage casing and the protector 60 or the protector 160 that includes the upper surface portion 62 as the cover portion and the arm portion 80 or the arm portion 180 as the attaching portion. However, the invention is not limited to this. For example, the medium storage device may be configured by a medium storage casing configured various other components and a protector including a cover portion and an attaching portion.

Further, in the above-described embodiment a case is described in which the banknote pay-in/pay-out device 10 as a medium processing device is configured by the cassette casing 36 as a medium storage casing and the protector 60 or the protector 160 that includes the upper surface portion 62 as the cover portion and the arm portion 80 or the arm portion 180 as the attaching portion. However, the invention is not limited to this. For example, the medium processing device may be configured by a medium storage casing configured various other components and a protector that includes a cover portion and an attaching portion.

INDUSTRIAL APPLICABILITY

The present invention may be employed in various devices such as, for example, ATMs, that are configured such that a storage box for storing a medium such as banknotes is attachable to and detachable from a casing and the storage box is protected from handling during transport.

The disclosure of Japanese Patent Application No. 2016-100649 filed on May 19, 2016, the entire contents which are incorporated herein by reference.

The invention claimed is:

1. A protector for protecting a casing having a side surface, one fitting portion on the side surface, and an opening through which the medium passes from an outside for storing the medium in an internal storage space or feeding the medium from the space to the outside, comprising:

a cover that is attachable to the casing for covering the opening; and an attaching portion fixed to an end of the cover and, when the cover is attached to the casing, extending so as to face toward the side surface, and forming another fitting portion that fits with the one fitting portion formed on the side surface of the casing.

2. The protector of claim 1, wherein for the side surface of the casing including two opposite side surfaces, the cover has opposite ends and the attaching portion extends from the opposite ends so as to face each of the opposite side surfaces of the casing, and the one fitting portion is formed on both side surfaces of the casing and the another fitting portion fits with the one fitting portion formed on the both side surfaces of the casing.

3. The protector of claim 2, wherein the one fitting portion includes a protrusion having a vertical elongated shape, and the another fitting portion includes a hole having a vertical elongated shape for the protrusion to fit therein.

4. The protector of claim 3, wherein the hole has a shape in which a width of a lower end portion thereof is wider than a width of an upper end portion thereof.

5. The protector of claim 1, wherein the one fitting portion includes a protrusion having a vertical elongated shape, and the another fitting portion includes a hole having a vertical elongated shape for the protrusion to fit therein.

6. The protector of claim 5, wherein the hole has a shape in which a width of a lower end portion thereof is wider than a width of an upper end portion thereof.

7. The protector of claim 1, wherein the cover has a buffer material at a portion thereof facing the opening.

8. The protector of claim 1, wherein the attaching portion is bent so as to avoid a handle provided at the casing when the protector is attached to the casing.

9. The protector of claim 8, wherein the protector is attached to the casing so as not to interfere with a movement trajectory of the handle.

10. The protector of claim 1, wherein the side surface of the casing includes two opposite side surfaces, and a lower end portion of the attaching portion is bent in a direction away from both of the two opposite side surfaces of the casing.

11. The protector of claim 1, wherein the protector has a color different than a color of the casing.

12. The protector of claim 1, wherein the protector is formed by bending one sheet metal.

13. The protector of claim 1, wherein the cover covers a cassette handover guide of the casing, that guides the medium passing through the opening in the casing.

14. The protector of claim 1, wherein the cover covers the entire opening.

15. A medium storage device, comprising:

a casing having an opening through which the medium passes from an outside for storing the medium in an internal storage space or feeding the medium from the internal storage space to the outside, the casing further having a side surface and one fitting portion formed on the side surface; and a protector that includes a cover that is attachable to the casing and covers the opening when attached to the casing, and an attaching portion that extends so as to face toward the side surface of the casing from an end of the cover, the attaching portion including another fitting portion that fits with the one fitting portion formed on the side surface of the casing, when the cover is attached to the casing.

16. A medium processing device, comprising:

a medium storage-casing that is configured so as to attachable to and detachable from a casing loading space formed in a predetermined frame, and that has an opening through which the medium passes from an outside for storing the medium in an internal storage space or feeding the medium from the internal storage space to the outside, the casing having a side surface and one fitting portion formed on the side surface; and a protector that includes a cover that is attachable to the casing and covers the opening when attached to the casing, and an attaching portion that extends so as to face toward the side surface of the casing from an end of the cover and includes another fitting portion that fits with the one fitting portion formed on the side surface of the casing.

17. The medium processing device of claim 16, wherein the loading of the casing is restricted by the frame contacting the attaching portion of the protector, when the casing in the state where the protector is attached to the casing is about to load to the casing loading space.

18. The medium processing device of claim 16, wherein the one fitting portion fits into a positioning portion of the predetermined frame, when the casing is loaded to the casing loading space.

* * * * *